United States Patent [19]

Minton

[11] 4,209,118

[45] Jun. 24, 1980

[54] GUIDE ROLL APPARATUS

[76] Inventor: Carl H. Minton, c/o ADS Machinery, P.O. Box 1027, Warren, Ohio 44482

[21] Appl. No.: 886,732

[22] Filed: Mar. 15, 1978

[51] Int. Cl.[2] ..... B65H 25/10; B65H 25/18; B65H 25/26

[52] U.S. Cl. ..... 226/21

[58] Field of Search ..... 226/21, 18, 19, 20, 226/22, 3, 198, 199; 242/57.1, 76

[56] References Cited

U.S. PATENT DOCUMENTS

| | | | |
|---|---|---|---|
| 1,189,611 | 7/1916 | Morse | 242/76 |
| 2,539,131 | 1/1951 | Gundersen et al. | 226/22 X |
| 2,654,599 | 10/1953 | Frisbie et al. | 226/21 |
| 2,716,026 | 8/1955 | Axworthy | 226/21 |
| 2,777,069 | 1/1957 | Saeman | 226/21 X |
| 2,782,030 | 2/1957 | Webster et al. | 226/21 |
| 2,989,265 | 6/1961 | Selsted | 242/76 |
| 3,040,944 | 6/1962 | Anderson | 226/21 |
| 3,090,534 | 5/1963 | Frommer et al. | 226/21 |
| 3,107,036 | 10/1963 | Richards et al. | 226/198 |
| 3,145,891 | 8/1964 | Herr et al. | 226/21 |
| 3,232,547 | 2/1966 | Thiede et al. | 226/20 X |
| 3,313,461 | 4/1967 | Anderson | 226/21 X |
| 3,406,887 | 10/1968 | Laycak | 226/21 |
| 3,610,494 | 10/1971 | Minton | 226/21 |
| 3,670,398 | 6/1972 | Minton | 29/505 |
| 3,985,276 | 10/1976 | Minton | 226/21 |
| 4,086,689 | 5/1978 | Martt | 226/21 X |

FOREIGN PATENT DOCUMENTS

| | | | |
|---|---|---|---|
| 47415 | 6/1951 | Canada | 226/21 |
| 1059559 | 2/1967 | United Kingdom | 226/21 |

*Primary Examiner*—Stanley N. Gilreath
*Attorney, Agent, or Firm*—Michael Williams

[57] ABSTRACT

My invention relates to guide roll apparatus for use in a metal strip processing line wherein it is desirable that the longitudinal centerline of the strip remains coincident with the centerline of the processing line. My improved guide roll apparatus embodies sensing mechanism to sense the position of a longitudinal edge of the strip as it moves in the processing line, the sensing mechanism sending an electrical signal to a circuit including solenoid controlled valves which control flow of compressed air to a pair of air cylinders which are in back-to-back relation and which tilt the steering roll to compensate for deviation of the strip from its desired path.

9 Claims, 10 Drawing Figures

S
10
11
12
14
15
16
17
18
19
20
21
22
24
25
33
38
39
43
44
45
46
60
67
68
72
77
78

℄ STRIP PROCESSING LINE
10
15
16
17
18
19
20
21
22
25
26
29
33
37
38
39
40
41
42
43
77
S
SE

FIG. 7.
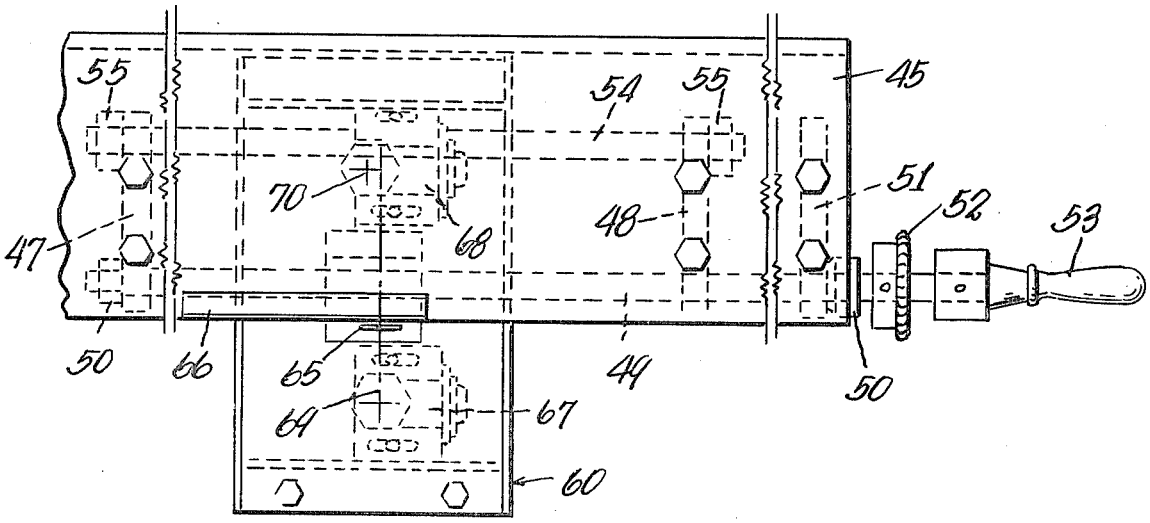
FIG. 8.
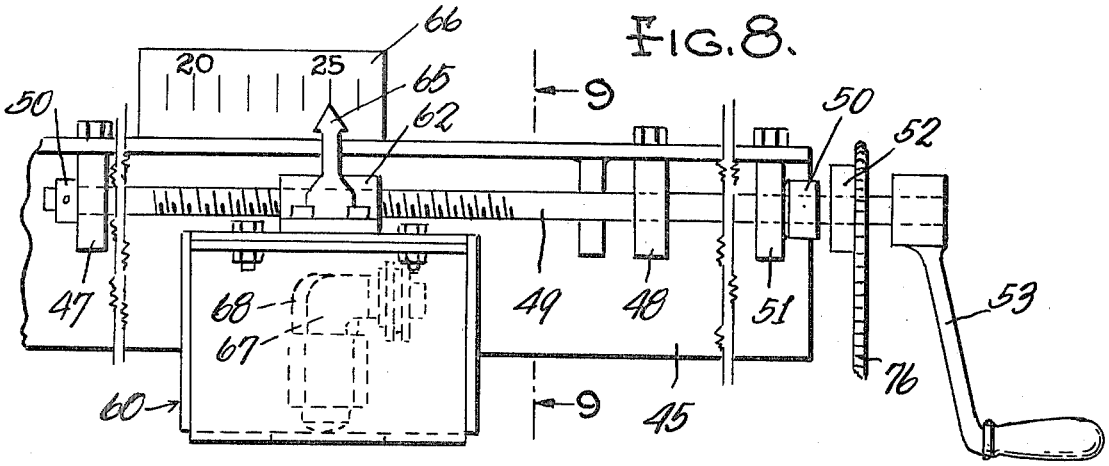
FIG. 9.
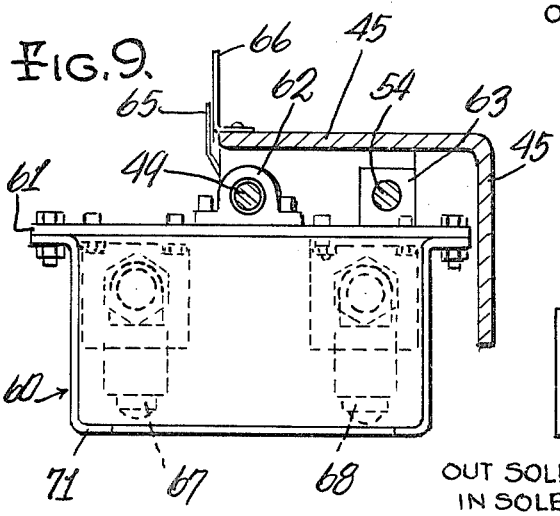
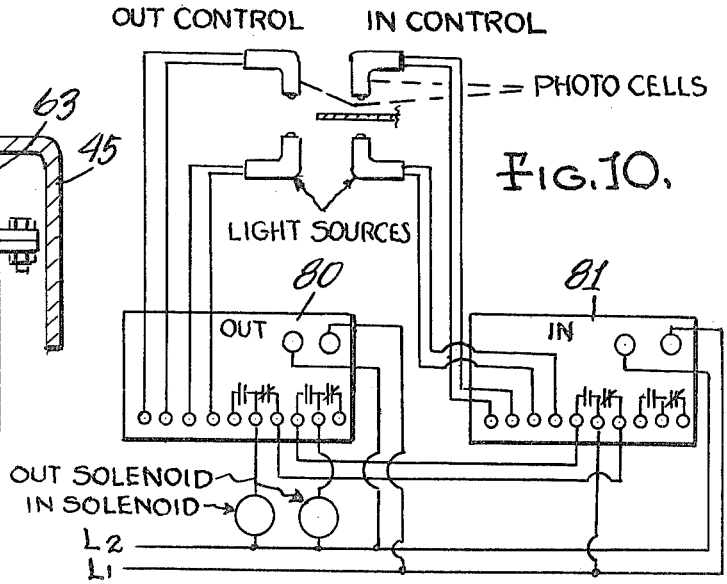
FIG. 10.

GUIDE ROLL APPARATUS

BACKGROUND AND SUMMARY

The prior art includes many patents on edge position detectors and web guiding apparatus and the steel processing industry presently uses apparatus of this general type for maintaining a running strip on the centerline of the processing line. Much of this apparatus includes hydraulic cylinders and circuitry to effect shifting of the strip from a deviated position back to the centerline of the strip processing line and, although such apparatus operates satisfactorily, it is clostly to install and maintain.

My improved apparatus utilizes air cylinders to effect shifting of the steering roll and thereby reduces the size, cost, and complexity of the web guiding apparatus now in use. In the prior art hydraulic systems, costly hydraulic pumps, accumulators and cylinders are required and this cost is eliminated in my apparatus since most shops have an air compressor and it is a simple matter to run a line therefrom.

Because of the use of air cylinders, my improved apparatus quickly shifts the steering roll from one position to another, and the amount of shift may be regulated by adjustable stops. This is a decided advantage since strip being pulled through an annealing furnace should have only a small angle of adjustment to avoid stretching of the strip an undue amount along one longitudinal margin.

DESCRIPTION OF THE DRAWINGS

In the drawings accompanying this specification and forming part of this application, there is shown, for purpose of illustration, an embodiment which my invention may assume, and in these drawings.

FIG. 7 is a fragmentary, broken top plan view of the sensing portion of my apparatus, FIG. 8 is a fragmentary, broken front view of the apparatus shown in FIG. 7, FIG. 9, is a fragmentary, sectional view corresponding generally to the line 9—9 of FIG. 8, and FIG. 10 is an electrical diagram of control circuitry.

DESCRIPTION OF THE PREFERRED EMBODIMENT

Figure 2:
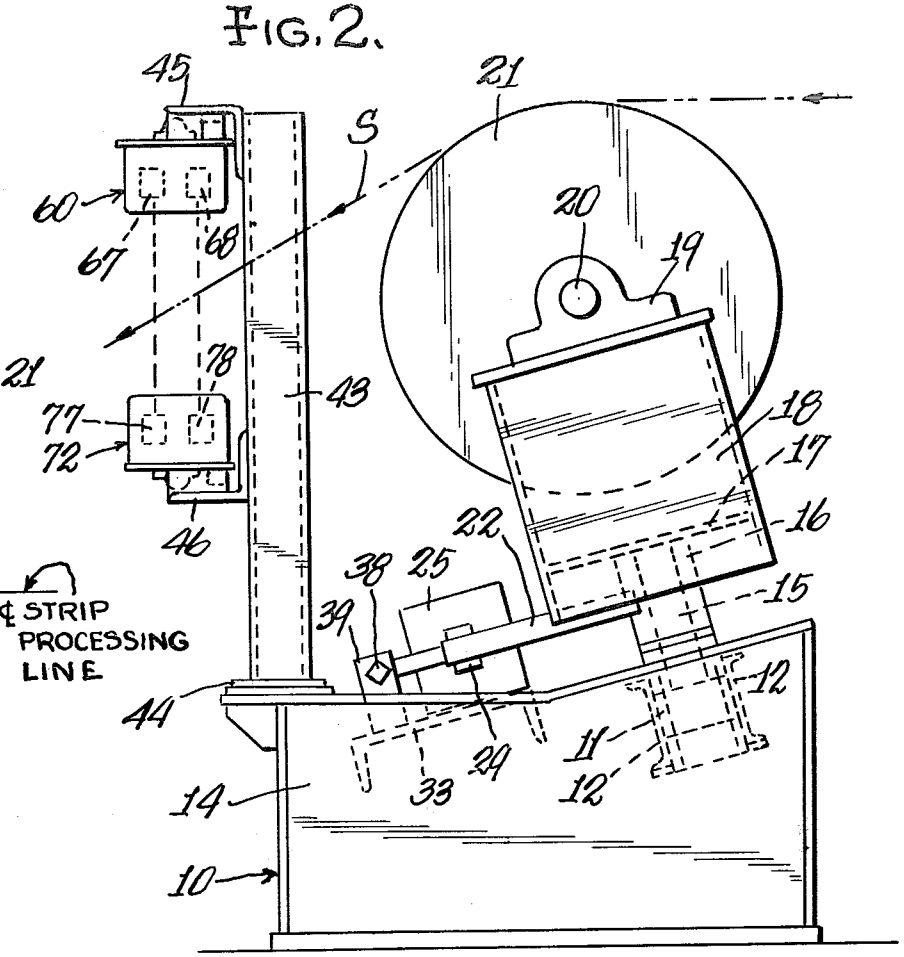
FIG. 2 is a side elevational view of the apparatus.
Figure 1:
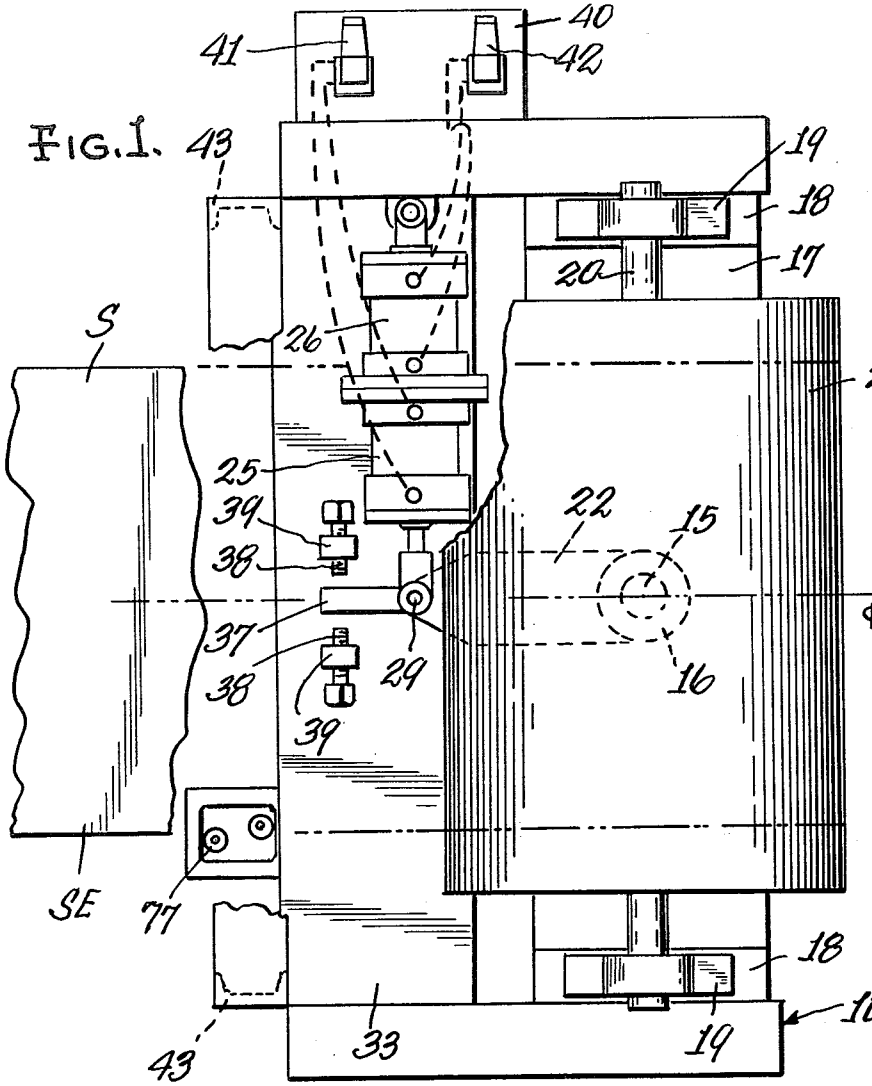
FIG. 1 is a top plan view of guide roll apparatus incorporating my invention, parts being broken away to better show details.

As seen in FIGS. 1 and 2, the apparatus herein disclosed is supported on a fabricated steel stand 10 and includes a centrally disposed upright tubular member 11. The member 11 is disposed between and welded to a pair of channels 12—12, the opposite ends of which are welded to respective side plates 14, only one of which is visible in FIG. 2.

The tubular member supports a shaft 15 and a further tubular member 16 is journalled on the shaft to rotate about the longitudinal axis of the same, with a thrust bearing between the two tubular members. As suggested in FIGS. 1 and 2, the longitudinal axis of the shaft 15 is substantially normal to and intersects the longitudinal centerline C of the strip processing line. Welded to the tubular member 16 at right angles to its axis is a heavy steel plate 17 which is adapted to extend crosswise of the apparatus. Upright housings 18—18 have their lower ends welded to the plate at opposite ends of the latter. Each housing, at its upper end, supports a pillow block bearing 19 and a shaft 20 has its opposite ends journalled within respective bearings. A steering roll 21, of conventional form, is fixed in any suitable manner to the shaft 20. The steel strip S is shown passing over a peripheral portion of the freely rotatable roll 21 in the direction of the arrows shown in FIG. 2, and this strip may be drawn in this direction by a bridle (not shown) of conventional form. It will be appreciated that the roll 21 may be driven and may coact with any suitable means to pull the strip through the line. Further, the strip may wrap under or along either side of a peripheral portion of the roll, depending on the manner in which the strip approaches the roll, it being important that the strip has a 15 to 90 degree wrap about the roll to prevent undesirable side slip.

Welded to the tubular member 16 and extending laterally therefrom, is a swing lever 22 which, when shifted in a plane at right angles to the axis of the member causes shifting of the roll 21 about the longitudinal axis of the shaft 15, and this action, if necessary, causes steering of the strip.

Figure 4:
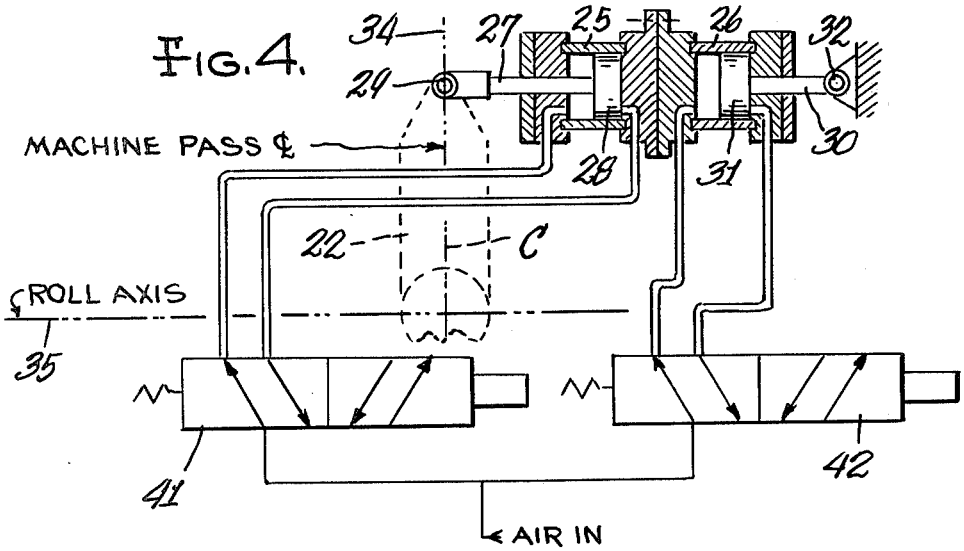
Figure 5:
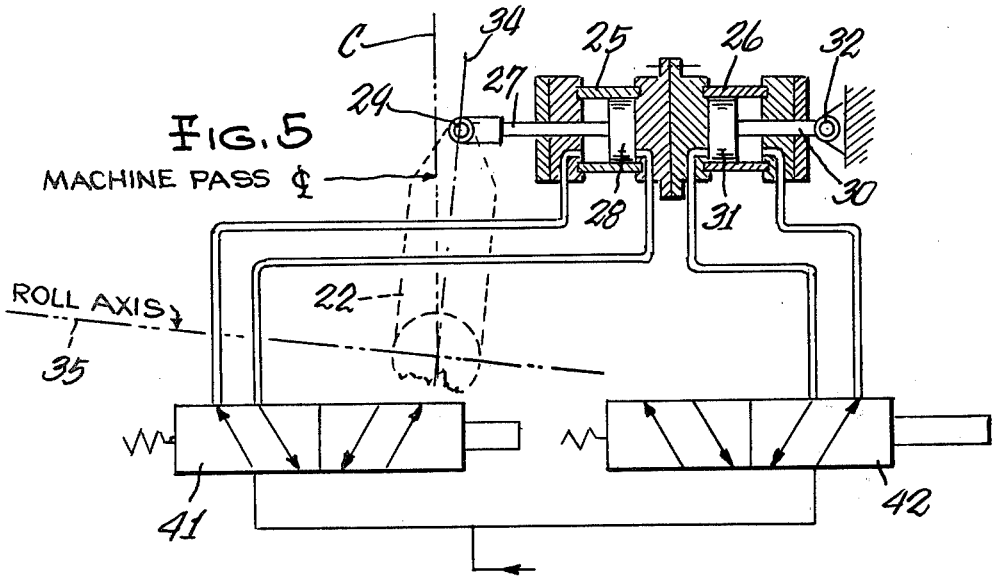
Figure 6:
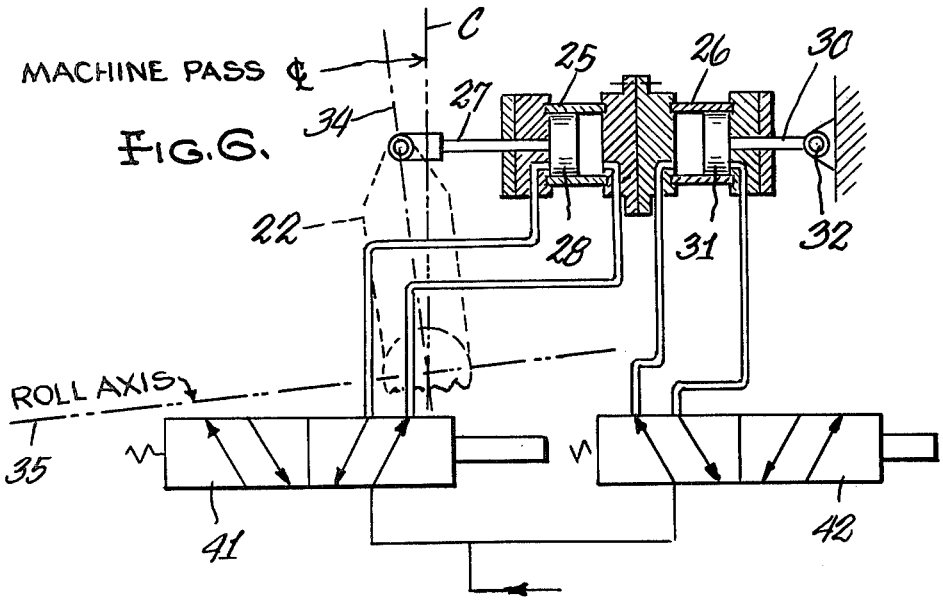

Shifting of the swing lever 22 is accomplished in novel manner by a pair of air cylinders 25 and 26, connected in back-to-back relation as best seen in FIGS. 4, 5, and 6. The rod 27 of cylinder 25 carries a piston 28 at its inner end and has its outer end pivotally connected at 29 to the free end of the swing lever. The rod 30 of the cylinder 26 carries a piston 31 at its inner end and has its outer end pivotally connected, at 32, to a part of the frame. A steel channel 33 (see FIG. 2) is welded crosswise of the frame side plates 14 in position so that its upper surface underlies the cylinders 25, 26 but is slightly spaced therefrom.

As best seen in FIGS. 4, 5, and 6, the blank end of cylinder 25 is connected to the blank end of cylinder 26 by means of bolts (not shown) or in any other suitable manner. The cylinders are supported by the pivotal connections 29 and 32, so as to be just clear of the upper surface of the channel 33 to avoid frictional drag, although the channel guards against damage to the cylinders should a pivotal connection 29 or 32 break.

As seen in FIG. 4, the swing lever 22, in its central position, has its longitudinal axis 34 on the centerline of the strip processing line C and maintains the axis 35 of the steering roll at right angles to such centerline, and this is the position maintained by the swing lever when no correction to the strip is required. The swing lever is maintained in central position by air admitted to the rod end of cylinder 25 and the blank end of cylinder 26, and this provides a rigid link of a predetermined length between the pivot points 29 and 32.

If the swing lever 22 is to be shifted to the right, as shown in FIG. 5, to correct deviation of the strip in one direction, air is admitted to the rod end of the cylinder 26 while air is still maintained at the rod end of cylinder 25. This drives the piston 31 to the blank end of cylinder 26 and in effect shortens the link between pivot points 29 and 32 and, since the pivot 32 is stationary, the cylinders 25 and 26 are bodily pulled to the right to swing the lever 22 and consequently the axis of the steering roll.

If the swing lever is to be shifted to the left, as shown in FIG. 6, to correct opposite deviation of the strip, air is admitted to the blank ends of both cylinders 25 and 26 to drive the pistons 28 and 31 to the rod ends of their cylinders. This, in effect, lengthens the link between pivots 29 and 32 and, since the pivot 32 is stationary, the cylinders are bodily pushed to the left, to swing the lever and consequently the axis of the steering roll.

Although air cylinders are preferred for reasons of economy, it will be appreciated back-to-back hydraulic cylinders will also provide the variable length link above described and it is not intended to limit this disclosure to air cylinders.

The cylinders 25 and 26 are preferably identical and their stroke is chosen to effect the maximum amount of shifting movement of the swing lever 22. In some cases, such as when strip is pulled through an annealing furnace, it is desirable to limit the shifting movement of the swing lever to a small amount to avoid stretching of the longitudinal margins of the strip. I therefore propose to provide adjustable stop means and one form which such means may assume is shown in FIGS. 1 and 2. As shown, the swing lever 22 may have a tail extension 37 which is disposed between a pair of adjusting bolts 38, the latter being threaded through respective lugs 39 which are welded to and extend upwardly from the channel 33.

My invention provides means for sensing the position of a longitudinal edge portion of the strip as it moves through the strip processing line, and to automatically correct any deviation from the centerline of such line. When deviation occurs, the sensing means sends an electrical signal to a circuit which includes solenoid-controlled air valves which control flow of air to the cylinders 25, 26 to effect their operation as above described.

As seen in FIG. 1, a ledge 40 extends outwardly from a side of the base 10 and supports a pair of solenoid-controlled air valves 41 and 42, which may be of any suitable commercially available type, such as Numatics MKT single solenoid spring return air valve, Model 11 SAD 4440. FIG. 1 illustrates, in dash lines, the air line connections between such valves and the air cylinders 25 and 26.

The sensing means is carried by a pair of upright channels 43—43 (see FIGS. 1 and 2), the lower ends of which are bolted to the base at 44. Spaced upper and lower angles 45 and 46 are bolted crosswise of the channels 43, the angles facing each other, as seen in FIG. 2. The upper and lower angles 45, 46 support similar devices and reference is made to FIGS. 7, 8, and 9, for detail disclosure of one of such devices. Metal blocks 47 and 48 are bolted to the horizontal flange of the angle 45 and extend downwardly from an inner surface thereof. A threaded rod 49 has its opposite ends journaled in respective blocks and is held against longitudinal movement by collars 50, the rod extending beyond the block 48 and through another block 51 which is also bolted to the horizontal flange of the angle 45. A sprocket 52 is pinned to the rod 49, outwardly of the block 51, and a hand crank 53 is pinned to the free end of the rod 49.

A bearing rod 54 has its opposite ends closely fitting through openings in the blocks 47, 48 and is rigidly held thereto by nuts 55. As seen in FIG. 9, the bearing rod 54 is parallel to but spaced inwardly of the threaded rod 49. A box shaped carriage 60 has a cover plate 61 to which are connected a threaded lug 62 and a bearing lug 63. The rod 49 is threaded through the lug 62 and the rod 54 receives the lug 63 in sliding relation. Therefore, when an operator rotates the crank 53, the carriage 60 is moved along the longitudinal axes of the rods 49 and 54. A pointer 65 is secured to the bearing block 62 and cooperates with a stationary scale 66 carried by the angle 45 to provide visual indication of the position of the carriage.

Bolted to the inside of the cover 61 and extending downwardly therefrom are two photo cells 67 and 68 of commercial construction, such as Frost Model PCAA 15 photocells. The centers of these photocells are offset, as shown by the lines 69 and 70 in FIG. 7. The photocells are mounted on the cover 61 for adjustment, as suggested in FIG. 7, so that the amount of offset may be adjusted. The bottom wall 71 of the carriage is formed with an elongated opening to pass light beams to the eyes of the photocells.

Figure 3:
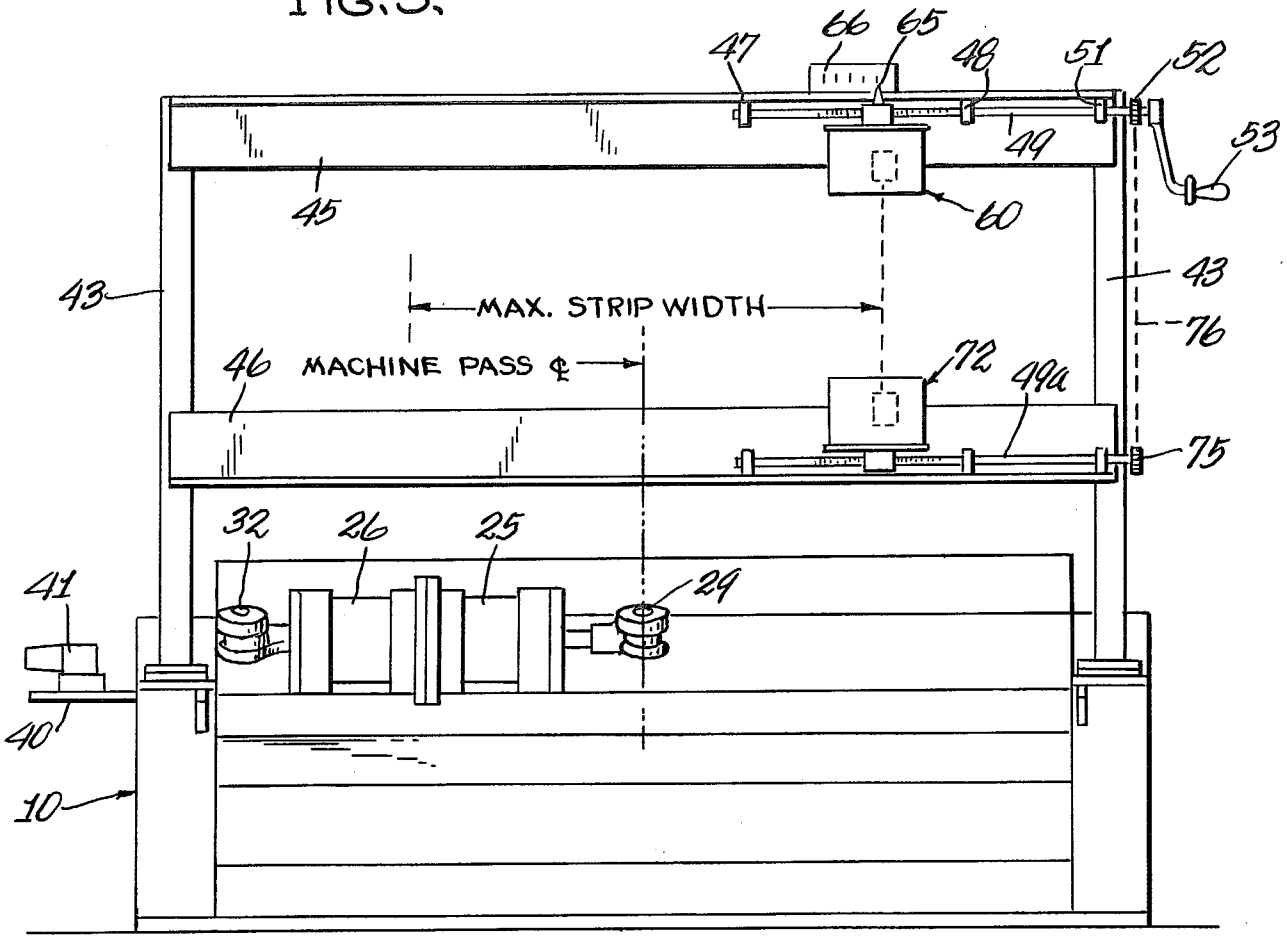
FIG. 3 is an elevational view of the apparatus, looking from the left hand side of FIG. 2, FIGS. 4, 5, and 6, are schematic views illustrating positions of the valves and air cylinders to accomplish steering roll operation.

The lower angle 46 (see FIGS. 2 and 3) supports a carriage 72 which is similar to the carriage 60 and which is mounted in similar manner, except that the carriage 72 extends upwardly from the horizontal flange of the angle 46. The threaded rod 49*a* (see FIG. 3) has a sprocket 75 pinned to its free end and, in this case, a handcrank is omitted. A chain 76 connects the sprockets 52 and 75 so that when the handcrank 53 is rotated, the carriages 60 and 72 are shifted simultaneously in the same direction and in equal amounts. As seen in FIG. 3, the carriages 60 and 72 are in vertical alignment.

Mounted within the carriage 72, in the same manner as the photo cells 67 and 68, are two light sources 77 and 78 of commercial construction, such as Frost Model LCAA15 light source, and these sources are vertically aligned with respective photocells.

As suggested in FIG. 1, the light sources are offset with respect to a longitudinal edge SE of the strip S. The photo cells 67 and 68 are constructed and arranged to be dark-operated; that is when dark, a photo cell will send an electrical signal to the circuitry shown in FIG. 10 to energize the coil of a predetermined solenoid so that the valve plunger connected with such solenoid will shift to provide air flow to the cylinders 25 and 26 to shift the swing lever 22 accordingly. The boxes designated by the numerals 80 and 81 in FIG. 10, may be Frost chassis-mounted controls, Series PRE, Model PRE-D11-1A0, and electrically connect the photo cells to the solenoids of the respective valves.

The electrical connection in such that if the light from source 78 is interrupted by the strip and the light from source 77 impinges on the eye of photocell 67, the swing lever 22 will be held in the central position shown in FIG. 4, and there will be no strip correction. If, for some reason the strip moves so that its running longitudinal portion covers both light sources to cut off light to both photocells, the solenoid valves will be operated to shift the swing lever to the position shown in FIG. 5 until deviation of the strip is corrected. If the strip shifts in the opposite direction to uncover both light sources and provide light to both photocells, the swing lever 22 will be shifted to the position shown in FIG. 6 until strip deviation is corrected.

I claim:

1. Roll guide apparatus insertable within a strip processing line for correcting deviation of a running strip from the longitudinal centerline of said processing line, comprising:

a base, a roll carried by said base for rotation about its longitudinal axis and for shifting movement about an axis transverse to said longitudinal axis, said roll being adapted to have said strip trained over a portion of its peripheral surface, link means for shifting said roll about said transverse axis, said link means having relatively moveable portions operable to change its effective length, said relatively movable portions comprising a pair of fluid cylinders connected in back-to-back relation, the rod of one cylinder being connected to said base and the rod of the other cylinder being connected to a lever which is effectively connected to said roll for shifting it about transverse axis, means operable to effect change in the length of said link means, and means for sensing deviation of said strip from the centerline of said strip processing line and operable to send a signal to said operable means and cause change in the length of said link means in correspondence with the deviation of said strip.

2. Roll guide apparatus insertable within a strip processing line for correcting deviation of a running strip from the longitudinal centerline of said strip processing line, comprising:

a base, a pivot member carried by said base and extending therefrom, the axis of said pivot member intersecting the longitudinal centerline of said strip processing line, a guide roll having a shaft, and adapted to have said strip trained over a portion of its peripheral surface, bearings carried by said pivot member and receiving opposite ends of said shaft, said bearings supporting said guide roll so that its axis of rotation is crosswise of the longitudinal centerline of said strip processing line, a lever extending from said pivot member and adapted to shift said guide roll about the axis of said pivot member, link means for shifting said lever, said link means having relatively movable portions operable to change its effective length, said relatively movable portions comprising a pair of fluid cylinders connected in back-to-back relation, the rod of one cylinder being connected to said base and the rod of the other cylinder being connected to said lever, means operable to effect change in the length of said link means, and means sensing deviation of said strip from the centerline of said strip processing line and operable to send a signal to said operable means and cause change in the length of said link means in correspondence with the deviation of said strip.

3. The construction according to claim 2 wherein adjustable stop means are provided to limit shifting of said guide roll a selected amount less than the stroke of said cylinders.

4. The construction according to claim 2 wherein each of said cylinders has a blank end and a rod end, said cylinders being ridigly joined in axial alignment with their blank ends in abutment.

5. The construction according to claim 4 wherein said operable means comprises a pair of solenoid valves for controlling flow of fluid to the blank and rod ends of each of said cylinders.

6. Roll guide apparatus insertable within a strip processing line for correcting deviation of a running strip from the longitudinal centerline of said processing line, comprising:

a base;

a roll carried by said base for rotation about its longitudinal axis and adapted to have said strip trained over a portion of its peripheral surface, said roll being bodily shiftable about another axis which transversely intersects and longitudinal axis intermediate the opposite ends of said roll, said other axis being defined by the longitudinal axis of a shaft, the latter being rotatable within bearings carried by said base, a lever having one end connected to said shaft for shifting said roll about said other axis, variable length link means comprising a pair of fluid cylinders, each having a blank end and a rod end, and a piston within each cylinder adapted to be driven between said blank and rod ends, and having a rod extending outwardly of such cylinder at its rod end, said cylinders being mechanically connected in blank end-to-blank end relation so that said rods extend in opposite directions from the oppositely disposed rod ends, one rod being connected to a stationary pivot and the other rod end being pivotally connected to the other end of said lever, and means for selectively directing pressurized fluid to the blank or rod ends of said cylinders in predetermined sequence to effect lengthening or shortening of said link means and thereby shift said lever and consequently said roll about said other axis in one direction or the other depending on the deviation of said strip from the longitudinal centerline of said processing line.

7. The construction according to claim 6 and further including valve means for controlling flow of pressurized fluid to said cylinders, and means responsive to the deviation of said strip from the longitudinal centerline of said processing line for controlling operation of said valve means.

8. The construction according to claim 7 wherein said valve means are controlled by said responsive means to effect disposition of said pistons in the following manner in accordance with strip disposition:

a. when said strip is in line with said longitudinal centerline, to dispose the pistion in one cylinder at the blank end of the latter, and to dispose the piston in the other cylinder at the rod end of the latter to provide a link of a predetermined length to hold said lever in a central position, b. when said strip has deviated from alignment with said longitudinal centerline in one direction, to maintain the piston in said one cylinder at the blank end of the latter, and to dispose the piston in said other cylinder at the blank end of the latter to provide a link shorter than said predetermined length to correspondingly shift said lever to one side of said central position, and c. when said strip has deviated from alignment with said longitudinal centerline in an opposite direction, to dispose the piston in said one cylinder at the rod end of the latter, and to dispose the piston in said other cylinder at the rod end of the latter to provide a link longer than said predetermined length to correspondingly shift said lever to the opposite side of said central position.

9. The construction according to claim 7 wherein said valve means comprise a pair of solenoid controlled valves and wherein said responsive means comprise a pair of light sources at one side surface of said strip and at a longitudinal margin thereof, and a pair of photocells at the opposite side surface of said strip and axially aligned with beams from respective light sources, said responsive means being operable to control flow of electric current to the coils of respective solenoids in accordance with the interruption of light by the longitudinal margin of said strip from a source to a respective photocell.

* * * * *